US005484018A

United States Patent [19]

Cavender et al.

[11] Patent Number: 5,484,018

[45] Date of Patent: Jan. 16, 1996

[54] METHOD FOR ACCESSING BYPASSED PRODUCTION ZONES

[75] Inventors: Travis W. Cavender, Angleton, Tex.; Joseph R. Murphey, Duncan, Okla.

[73] Assignee: Halliburton Company, Houston, Tex.

[21] Appl. No.: 291,302

[22] Filed: Aug. 16, 1994

[51] Int. Cl.[6] ..... E21B 43/14; E21B 33/16

[52] U.S. Cl. ..... 166/291; 166/292; 166/297

[58] Field of Search ..... 166/297, 291, 166/285, 292, 55.1

[56] References Cited

U.S. PATENT DOCUMENTS

| | | | |
|---|---|---|---|
| 2,839,142 | 6/1958 | Huber | 166/297 |
| 3,130,784 | 4/1964 | Pennington, II | 166/297 X |
| 3,724,550 | 4/1973 | Lanmon, II | 166/313 X |
| 4,612,992 | 9/1986 | Vann et al. | 166/297 |
| 4,637,468 | 1/1987 | Derrick | 166/297 |

*Primary Examiner*—Stephen J. Novosad

*Attorney, Agent, or Firm*—William M. Imwalle; Ned L. Conley

[57] ABSTRACT

A method for establishing production of oil or gas from a secondary production zone which is above a primary production zone in a well in which a settable material is placed in the annulus between the casing and the tubing above the secondary production zone and allowed to set up, and the secondary zone is then perforated with a through-tubing perforating gun.

4 Claims, 1 Drawing Sheet

METHOD FOR ACCESSING BYPASSED PRODUCTION ZONES

TECHNICAL FIELD OF THE INVENTION

This invention relates to a method for re-completing an oil or gas well to establish production of oil or gas from a zone which was bypassed in the original completion of the well.

BACKGROUND OF THE INVENTION

During the drilling of most oil and gas wells located offshore or in inland waters one or more productive zones may be penetrated before the wellbore reaches the primary zone from which the operator wishes to produce oil or gas. These wells are then completed for production from this primary zone, with the intention of later re-completing for production from the other zones after the primary zone is depleted. However, to re-complete a well it has been necessary to pull all the tubing, isolate the original production zone, cement, perforate and reinstall the tubing and production equipment. These operations require mobilization and demobilization of a completion rig, at a cost of one half million to one million dollars or more. As a result, it is often economically infeasible to re-complete to the secondary zones, so wells are often abandoned when the primary production zone is depleted.

In secondary completion methods previously used, cement weighing perhaps 15.6 pounds per gallon is pumped down the annulus between the tubing and the casing to isolate the secondary production zone. This cement plug is then pressure tested, and the production zone is perforated. The perforating gun must fire through the tubing wall, the cement and the casing wall before it can reach the formation. Moreover, only a very small perforating gun can be used in the production tubing. For example the maximum size perforating gun which will fit into a 2-3/8 inch tubing is 1-11/16ths inch in diameter and the maximum size which will fit into a 2-7/8 inch tubing is 2-1/8 inch in diameter. Because of the small size of the perforating gun, there is a limited amount of energy which can be imparted to form the perforations. For this reason, when it is necessary to perforate through the tubing wall, the cement and then the casing wall, there is often very little energy left to provide any significant perforation of the formation. The flow rate of oil and gas through such perforations is much less than through conventional perforations.

SUMMARY OF THE INVENTION

It is an object of this invention to provide a method for re-completing a well at a secondary formation without incurring the cost of mobilizing and demobilizing a completion rig.

It is another object of this invention to provide a method for increasing the depth of production perforations obtained in re-completing a well at a secondary formation.

According to this invention the production tubing for the primary formation is not pulled, but is used as a conduit for wire line tools and fluids used in re-completion. The primary formation is first isolated, then the tubing is perforated several feet below the secondary formation, using a perforating gun lowered through the tubing on a wire line, to provide a conduit for a settable annulus pack-off material. The pack-off material is placed in the annulus between the tubing and the casing and above the secondary production zone, where it will not interfere with or degradate perforation efficiency into the secondary production zone, and allowed to set up. The tubing in the proposed secondary production interval is then perforated using a high efficiency through tubing perforating gun. Since there is no cement in the annulus through which the perforating gun must fire, the full power of the perforating gun may be utilized in perforating the tubing, the casing and the surrounding formation instead of being absorbed in cement.

The method of this invention therefore significantly reduces the cost of re-completing after the primary zone is depleted, by eliminating the cost of the completion rig. In addition, it allows much more efficient perforating so that production is increased over that which has previously been obtainable in re-completions for secondary formations.

BRIEF DESCRIPTION OF THE DRAWINGS

The single FIGURE of the drawing illustrates an embodiment of the method of this invention.

DETAILED DESCRIPTION OF A PREFERRED EMBODIMENTS

Figure 1:
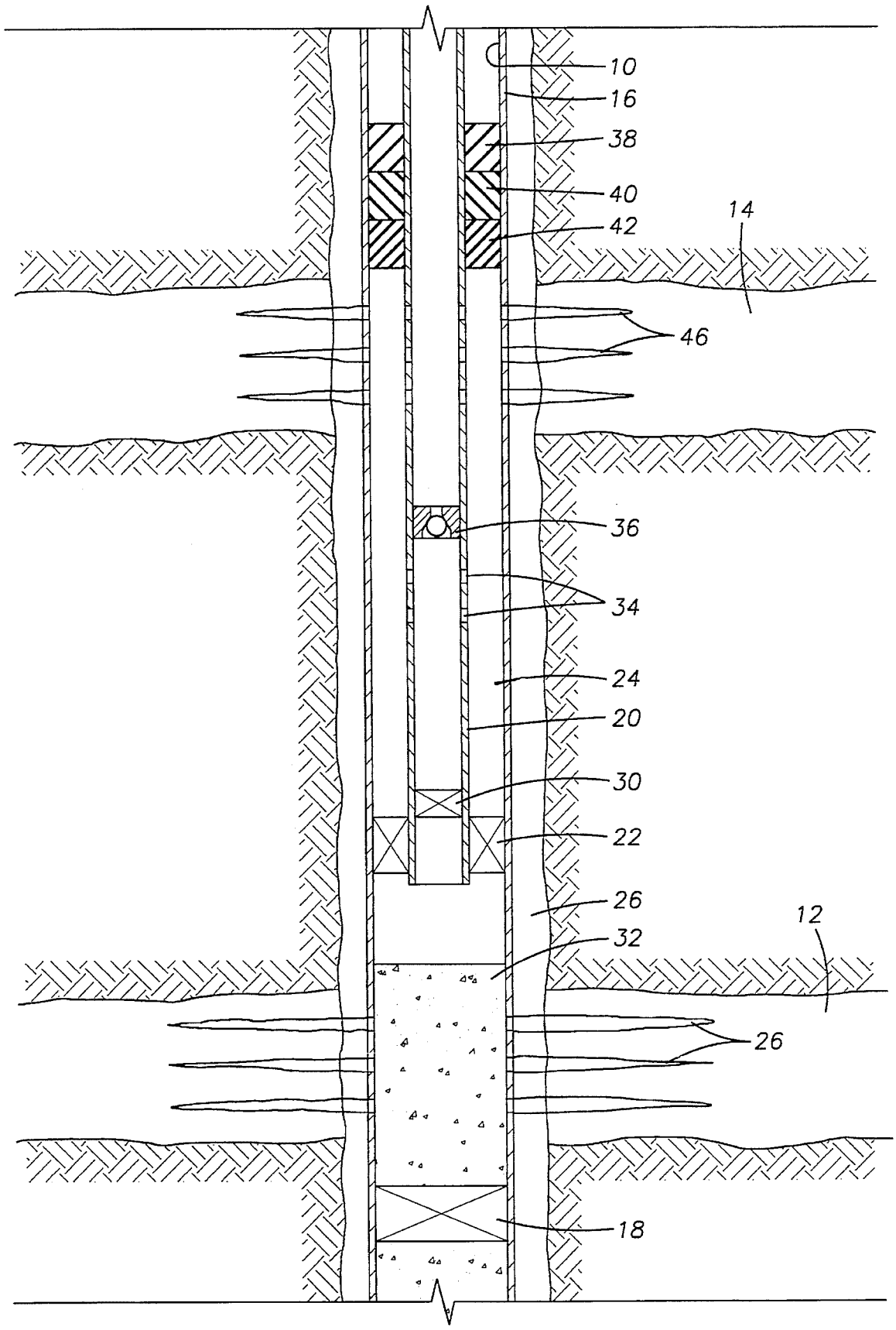

The drawing shows a section of a wellbore 10 which traverses a lower primary production zone 12 and an upper secondary production zone 14. As shown, the wellbore is lined with a casing 16 which extends to below the primary production zone 12. A packer 18 closes the lower end of the casing below production zone 12. A production tubing 20 is concentrically disposed within the casing and extends downwardly to a point above production zone 12. A packer 22 closes off the annulus 24 between the tubing and the casing.

In the original drilling of the well a drilling rig was used to handle the drill pipe for the drilling operation and to set the casing. In the drilling operation the secondary zone 14 was bypassed, and when the casing was set it was run down to below the lower end of the primary zone 12. The casing was then cemented with the cement flowing out the bottom of the casing and upwardly around the casing into the annulus 26 between the casing and the wellbore until the annulus was filled to above the upper end of the primary zone 12. The cement may extend up the annulus 26, as shown in the drawing, to above the secondary zone 14. A plug 18 was pumped down on top of the cement to hold the cement in place until it set up.

A perforating gun was then lowered into the well until it was opposite the primary production zone 12. At this point the perforating gun was fired to penetrate the casing wall, the cement in the annulus and the production zone with perforations 28.

When the primary production zone has been substantially depleted of oil and gas, the present invention is used to complete the secondary production zone 14. According to this invention the existing perforations into the primary production zone are squeezed off as required by applicable regulatory requirements. A bridge plug 30, preferably cast iron, is then lowered by wire line and set in the tubing several feet, preferably at least eight to ten feet, below the proposed re-completion interval. A perforating gun is then lowered through the tubing on a wire line to a point below the secondary formation 14 and a short distance, preferably one or two feet, above the bridge plug, and actuated to perforate the tubing as shown at 34. The perforating gun is then withdrawn and a check valve 36 is installed, again using a wire line, in the tubing above the perforations 34. A completion fluid, weighted as required for the formation pressure, and containing a surfactant for cleaning the tubing bore and the annulus 24 between the tubing and the casing, is then circulated through the tubing and the annulus. Such completion fluids are well known in the art, and may be water, sea water, calcium chloride brine or other material weighted to counteract the differential pressure of the formation. Completion fluid is then withdrawn to approximately the level of the perforations 34.

An annulus packoff treatment is then introduced into the tubing and caused to move downwardly therein to the perforations 34, through the perforations, and into the annulus 24. In a preferred embodiment of the invention, the annulus packoff treatment consists of a first comparatively low density spacer material, followed by a second higher density settable material followed by a third still higher density spacer material, with each of the materials of the annulus packoff treatment having a density lower than that of the completion fluid. A wiper dart is then released and displaced downwardly with wellbore fluids to position it above the check valve 36, thereby forcing the annulus packoff treatment through the perforations 34 into the annulus 24. The three components of the annulus packoff material are forced upwardly in the annulus to above the secondary production zone 14. The relative weights of the materials will cause them to segregate according to density so that the fighter spacer material 38 is on top, the intermediate weight settable material 40 is just below the lighter spacer material, and the heavier spacer material 42 is below the settable material. The still heavier completion fluid 44 fills the annulus below the heavier weight spacer material. The check valve 36 prevents the materials from flowing back through the perforations 34. Once the materials are in place, the well is shut in until sufficient time has elapsed for the settable material 40 to set up so as to provide a solid plug in the annulus above the secondary formation 14, thereby forming a pack-off. The annulus is then pressure tested to be sure that the plug has isolated the secondary formation. A high efficiency through-tubing perforating gun is then lowered down the tubing until it reaches the desired perforating level and is fired to perforate the tubing, the casing, the cement surrounding the casing and the formation, as shown at 46. If necessary or desirable, known sand consolidation procedures may be carried out at this point, using, for example, coil tubing or snubbing pipe. The tubing may then be swabbed to unload the completion fluid, and production of the secondary formation may be begun.

The term "settable material" as used herein refers to any suitable liquid material which will set up under the conditions described to seal off the annulus and prevent fluids produced from the formation from moving upwardly in the annulus 24. It is necessary that the settable material remain liquid long enough to pump it into the tubing and position it at the desired location, and then set up within a few hours. Preferably, the settable material should not be miscible with water and is resistant to attack by any organic or inorganic acids which may be utilized for re-completion or for well treatment. A suitable settable material is Epseal, a pumpable epoxy resin composition sold by Halliburton Corporation of Duncan, Okla., some embodiments of which are disclosed in U.S. Pat. Nos. 3,960,801 and 4,072,194. Epseal may be weighted, e.g. by filling with spherlite or other filler, to the desired density. Although the drawing shows a very short length of settable material and the two spacer materials, enough of the settable material should be introduced to fill at least about 20 vertical feet, and preferably from 50 to 300 vertical feet of the annulus. The spacer materials used may consist of a sufficient length, e.g. 50 feet or more, of any liquid which will provide a buffer between the settable material and the completion fluid, so that the completion fluid will not interfere with the setting of the settable fluid. The spacer material should not be miscible with the completion fluid, so usually it will be oil based for use with an aqueous completion fluid. The spacer material should also have the capability of being weighted as necessary to provide the density required to position it above or below the settable material. A suitable spacer fluid is Halliburton's My-T-Oil, an oil filled with a polymeric material for thickening and weighting to achieve the desired density. To insure sufficient separation of the settable material and the spacer fluid, enough of each spacer fluid should be provided to occupy at least 50 feet, and preferably at least 100 feet of the annulus.

Various embodiments of the invention have been shown and described. However, the invention is not limited to these embodiments, but includes all variations within the scope of the appended claims, and equivalents thereof.

What is claimed is:

1. A method for establishing production of oil or gas from a secondary production zone which is above a primary production zone in a well having a casing and a concentric production tubing with an annular space between the casing and the tubing, comprising isolating the primary production zone, perforating the tubing at a level below the secondary production zone and above the primary production zone to provide a circulation path including the tubing, the perforations and the annular space, circulating a completion fluid through said circulation path to clean the tubing and the annulus, pumping into the tubing an annulus pack-off treatment comprising, in sequence, a liquid spacer material having a relatively low density, a liquid settable material having a density greater than said spacer material and a second liquid spacer material having a density greater than the settable material, all of said materials having a density less than the completion fluid, placing the settable material in the annular space and allowing it to set up, and perforating the secondary zone with a through-tubing perforating gun, said settable material being positioned so that it is entirely above the perforations.

2. A method for establishing production of oil or gas from a secondary production zone which is above a primary production zone in a well having a casing and a concentric production tubing with an annular space between the casing and the tubing, comprising placing a settable material in the annular space above the secondary production zone and allowing it to set up, and perforating the secondary zone through a portion of the annular space which is free of settable material with a through-tubing perforating gun, the settable material being pumped down the tubing, preceded by a spacer material which has a density less than the density of the settable material and followed by a spacer material which has a density greater than the density of the settable material.

3. A method as defined by claim 2 in which a completion fluid having a density greater than the density of the spacer materials and the settable material is in the tubing and the annular space.

4. A method for establishing production of oil or gas from a secondary production zone which is above a primary production zone in a well having a casing and a concentric production tubing with an annular space between the casing and the tubing, comprising forming perforations in the tubing at a level below the secondary zone, pumping a settable material downwardly through the tubing and through said perforations to the annular space above the secondary production zone, allowing the settable material to set up, and perforating the secondary zone with a through-tubing perforating gun prior to placing the settable material, and the settable material is pumped through the perforations to its position in the annular space.

* * * * *